US008696891B2

(12) United States Patent
Hastings

(10) Patent No.: US 8,696,891 B2
(45) Date of Patent: Apr. 15, 2014

(54) SYSTEM AND METHOD FOR EXTRACTING BITUMEN FROM TAR SAND

(76) Inventor: Larry W. Hastings, Owensboro, KY (US)

( * ) Notice: Subject to any disclaimer, the term of this patent is extended or adjusted under 35 U.S.C. 154(b) by 649 days.

(21) Appl. No.: 12/727,892

(22) Filed: Mar. 19, 2010

(65) Prior Publication Data

US 2010/0236991 A1 Sep. 23, 2010

Related U.S. Application Data

(60) Provisional application No. 61/162,270, filed on Mar. 21, 2009.

(51) Int. Cl.
*C10G 1/04* (2006.01)

(52) U.S. Cl.
USPC ..... 208/390; 208/391; 196/14.52; 196/138; 196/139; 196/140

(58) Field of Classification Search
CPC ..... C10G 1/04; C10G 1/047; C10G 1/18
USPC ..... 196/14.52, 138, 139, 140; 208/390, 208/309, 391; 209/268; 202/168, 170, 172, 202/173, 176
See application file for complete search history.

(56) References Cited

U.S. PATENT DOCUMENTS

| | | | | | |
|---|---|---|---|---|---|
| 1,862,945 | A * | 6/1932 | Schlotterhose | ..... | 554/175 |
| 4,311,561 | A * | 1/1982 | Hastings | ..... | 196/14.52 |
| 4,532,024 | A * | 7/1985 | Haschke et al. | ..... | 208/390 |
| 5,092,983 | A * | 3/1992 | Eppig et al. | ..... | 208/323 |
| 5,264,118 | A * | 11/1993 | Cymerman et al. | ..... | 208/390 |
| 6,207,044 | B1 * | 3/2001 | Brimhall | ..... | 208/390 |
| 7,431,830 | B2 * | 10/2008 | Cleminson et al. | ..... | 208/390 |
| 2007/0095076 | A1 * | 5/2007 | Duke et al. | ..... | 62/49.2 |
| 2008/0035531 | A1 * | 2/2008 | Coveley | ..... | 208/390 |

* cited by examiner

*Primary Examiner* — Nina Bhat
(74) *Attorney, Agent, or Firm* — Middleton Reutlinger; Alexander P. Brackett

(57) ABSTRACT

An improved system for removing bitumen from tar sands comprises a pre-treatment system utilizing a vibratory load hopper for classifying and sizing said tar sand particles communicating with a dryer for heating and drying said tar sand particles to a predetermined temperature thereby controlling the moisture content of said tar sands. An extraction system is also included for accepting said tar sands from the dryer comprising a plurality of extraction vessels arranged in series for transporting said tar sands from a first extraction vessel to a final extraction vessel. Furthermore, a solvent system for supplying a predetermined volume of solvent flow through said extraction vessels is employed, whereby solvent is supplied to the last extraction vessel and a solvent and bitumen mixture is withdrawn from the first extraction vessel.

20 Claims, 9 Drawing Sheets

SYSTEM AND METHOD FOR EXTRACTING BITUMEN FROM TAR SAND

CROSS-REFERENCE TO RELATED APPLICATIONS

This application claims the benefit of U.S. Provisional Patent Application Ser. No. 61/162,270 filed Mar. 21, 2009 and entitled "System And Method For Extracting Bitumen From Tar Sand".

BACKGROUND OF THE INVENTION

1. Field of the Invention

The present invention relates generally to a system and method for extracting bitumen from tar sands and more particularly to an improved system and method of bitumen extraction that enable the operation of a continuous, cost-effective and reliable process for such extraction.

2. Description of the Related Art

A variety of prior art patents teach or disclose various processes for extracting bitumen from tar sand flows, and thus producing crude for further refining and processing, as is known in the art. For example, U.S. Pat. Nos. 3,941,679 to Smith et al., 4,120,775 to Murray et al., 3,856,474 to Pittman et al., 1,862,945 to Schlotterhose, and 1,024,230 to Turner et al. each teach systems and concomitant apparatus for separating hydrocarbons from tar sands and the like.

Furthermore, U.S. Pat. No. 4,311,561 to Hastings, incorporated herein by reference, offers further improvements to the prior art. The '561 reference teaches an improved system for extraction of bitumen from tar sands by flowing the tar sands and a suitable solvent in a first direction through a plurality of serial extraction chambers while a flow of extracted bitumen and solvent are moved counter to the flow of the tar sand feedstock. The feed stock of tar sands are fed into an initial extraction chamber utilizing a hopper, conveyor, or similar feeding apparatus, as is well known in the art. Solvent is introduced in the "last" extractor in the series, whereby the flow of solvent—and thus extracted bitumen—is counter to the flow of the tar sands through the extraction chambers.

In this fashion the amount of bitumen contained in the tar sand in each successive extraction chamber is reduced until, in the final extraction chamber, only sand and solvent remain. At this point in the process the sand and solvent are treated with hot water to remove (or separate out) the solvent from the sand, which solvent may then be reused in the process.

Each extraction chamber comprises a an agitator for effecting mixing of tar sand and solvent and further with a circulating system for bringing solvent and bitumen solution from the top of the chamber for discharge into the bottom thereof adjacent the agitator. The tar sand and solvent mixture in each extraction chamber is removed therefrom and discharged into a successive chamber by operation of a conveyor extending from the bottom of each chamber to the top of the next successive chamber.

In this fashion, the extracted bitumen and solvent are removed from the "first" extraction chamber in the chain of extraction chambers for further processing and, ultimately, the refining of hydrocarbon products from the bitumen.

One difficulty with prior art systems such as those described and discussed briefly herein above is the continued presence of particulates or fines in the extracted bitumen and solvent mixture. The presence of these particulates is highly undesirable since they make the continued processing of bitumen considerably more difficult, requiring various and sundry apparatus for their removal. Accordingly, it is readily seen that an extracted bitumen and solvent solution or mixture having a very low particulate content is highly desirable for clean and efficient production of hydrocarbons.

Additionally, one further difficulty with the aforementioned process is the situation where the moisture content of the tar sands entering the extraction process is variable, either too high or too low, due to the presence of environmental moisture. For example, when the tar sands are subjected to a down pour of rain, or snow-covered prior to entering the process, the moisture content thereof will be considerably higher than when the feed stock is fed into the system on a dry day. This wide variability in moisture content causes great difficulty in keeping a steady-state flow of extracted bitumen, which leads to many process delays and even shut-downs. These inefficiencies are of course quite costly, both in lost production and labor required to restart or re-balance the process.

One additional disadvantage with the prior art processes discussed above is the high cost of the solvent necessary to extract the bitumen from the tar sands and the relative inefficiency of these systems at recovering the solvent from the bitumen-depleted sand, thereby greatly enhancing cost. Accordingly, there is a great need in the art for a bitumen extraction system and method that provides for efficient solvent recovery throughout the process.

SUMMARY OF THE INVENTION

The present invention provides a system and method for extracting bitumen from tar sand that utilizes a novel feed stock pre-treatment process to provided tar sands to the process having a pre-determined moisture content, thereby enhancing process reliability and obviating the need to modify tar sand or solvent flow rates to compensate for slower or faster bitumen extraction. By assuring a consistent feed stock moisture content the downstream portions of the bitumen extraction process operate more smoothly, thus providing for less system down-time and greater reliability.

The invention additionally includes an improved system and method for introducing and providing a counter-flow of solvent through a plurality of extraction chambers or extractors that provides for a ratio of solvent to feed stock (or tar sand) media greater than that used in the prior art, thereby providing for an extracted bitumen and solvent mixture that is very low in particulates or fines, albeit quite high in solvent.

Additionally, the invention comprises an improved dissolventizer (DT) apparatus and system, utilizing high pressure steam for the removal of reprocessing of solvent from the remaining sand in the extraction process. This improved DT also utilizes a plurality of novel drying trays onto which sand is deposited, and onto which high pressure steam is directed at a controlled flow rate, thereby liberating solvent from the sand at a constant rate and removing said solvent through a solvent evaporation and condensing system, which is also ultimately recovered in the solvent recovery process of the instant invention.

The present invention further incorporates an improved bitumen refining process for separating bitumen from the solvent used to extract bitumen from the tar sands that permits recovery of greater amounts of solvents than prior art systems and that produces bitumen having minimal contamination, thereby providing for a more efficient and cost-effective refining process.

Other features, advantages and objects of the invention will become apparent from the detailed description of the preferred embodiment(s) set forth herein below, taken in conjunction with the attached drawing Figures.

BRIEF DESCRIPTION OF THE DRAWING FIGURES

DETAILED DESCRIPTION OF THE PREFERRED EMBODIMENT(S)

Figure 1:
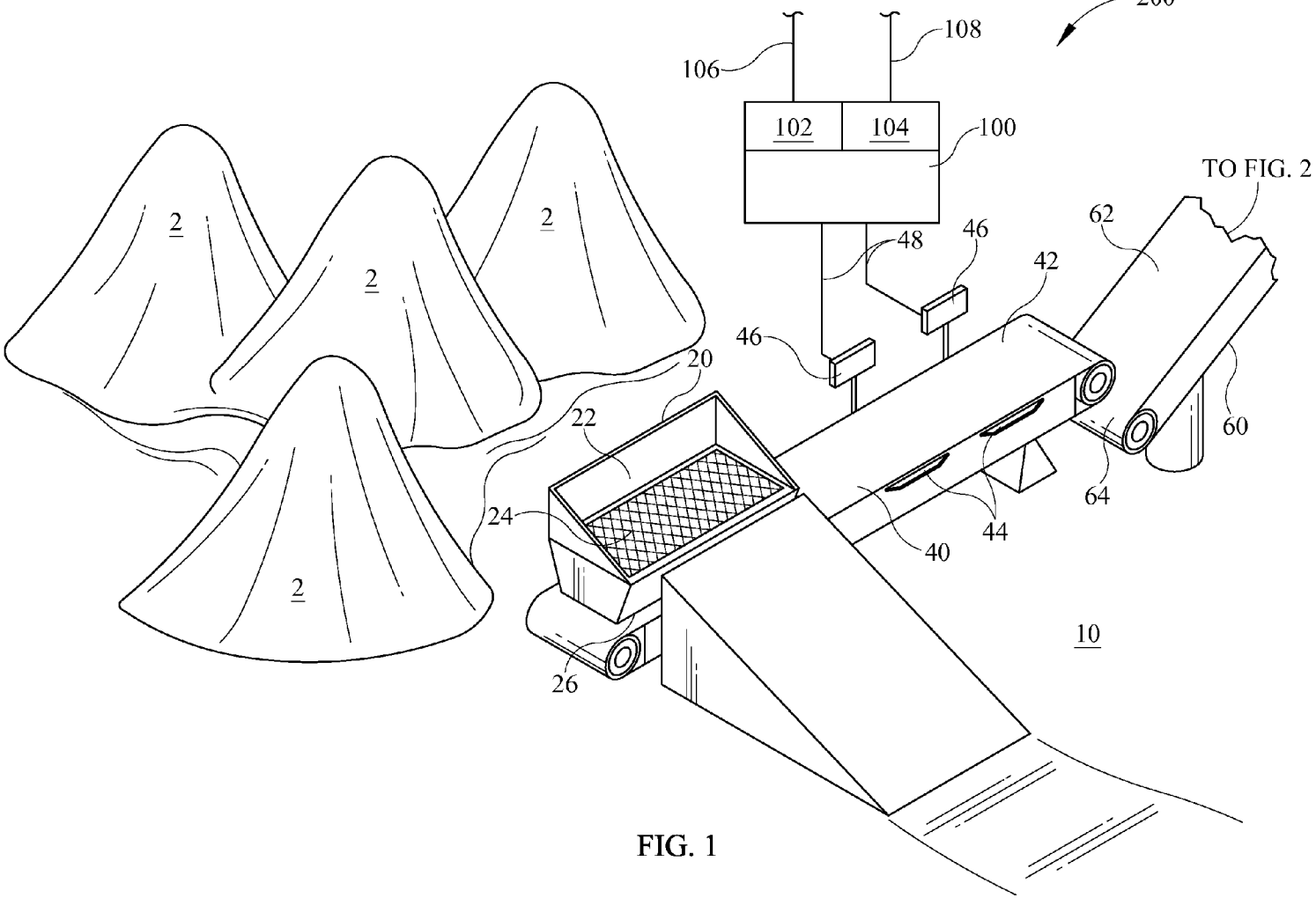
FIG. 1 is a partial process flow diagram of the pre-treatment of the system and method of extracting bitumen from tar sands in accordance with one embodiment of the present invention.

Referring now to drawing FIGS. 1-9, and in accordance with one embodiment of the present invention, a system 10 and method of extracting bitumen 1 from tar sand 2 comprises generally a pre-treatment system 200 for preparing tar sands 2 for bitumen 1 extraction, an extraction system 300 for removing bitumen 1 from the prepared tar sands 2 utilizing a solvent 3, a solvent system 400 for supplying and reclaiming solvent to and from said extraction system 300 , and a refining system 600 for separating solvent 3 from the extracted bitumen 1 to produce a hydrocarbon finished product capable of further refinement. Throughout this specification, the terms tar sand 2 and feed stock 2 are used interchangeably to refer to tar sands 2 that are processed by system 10 and the method disclosed herein to produce hydrocarbons such as asphalt, oil, diesel fuel, kerosene, gasoline, and liquid propane. Additionally, the system 10 and method of the present invention require the use several ancillary process systems, generally available in manufacturing environments, such as a process steam 4 supply, a cooling water 6 supply, and a super-heated steam 8 supply. Accordingly, these ancillary systems are not shown in the drawing Figures for the sake of clarity and convenience in explication.

Figure 2:
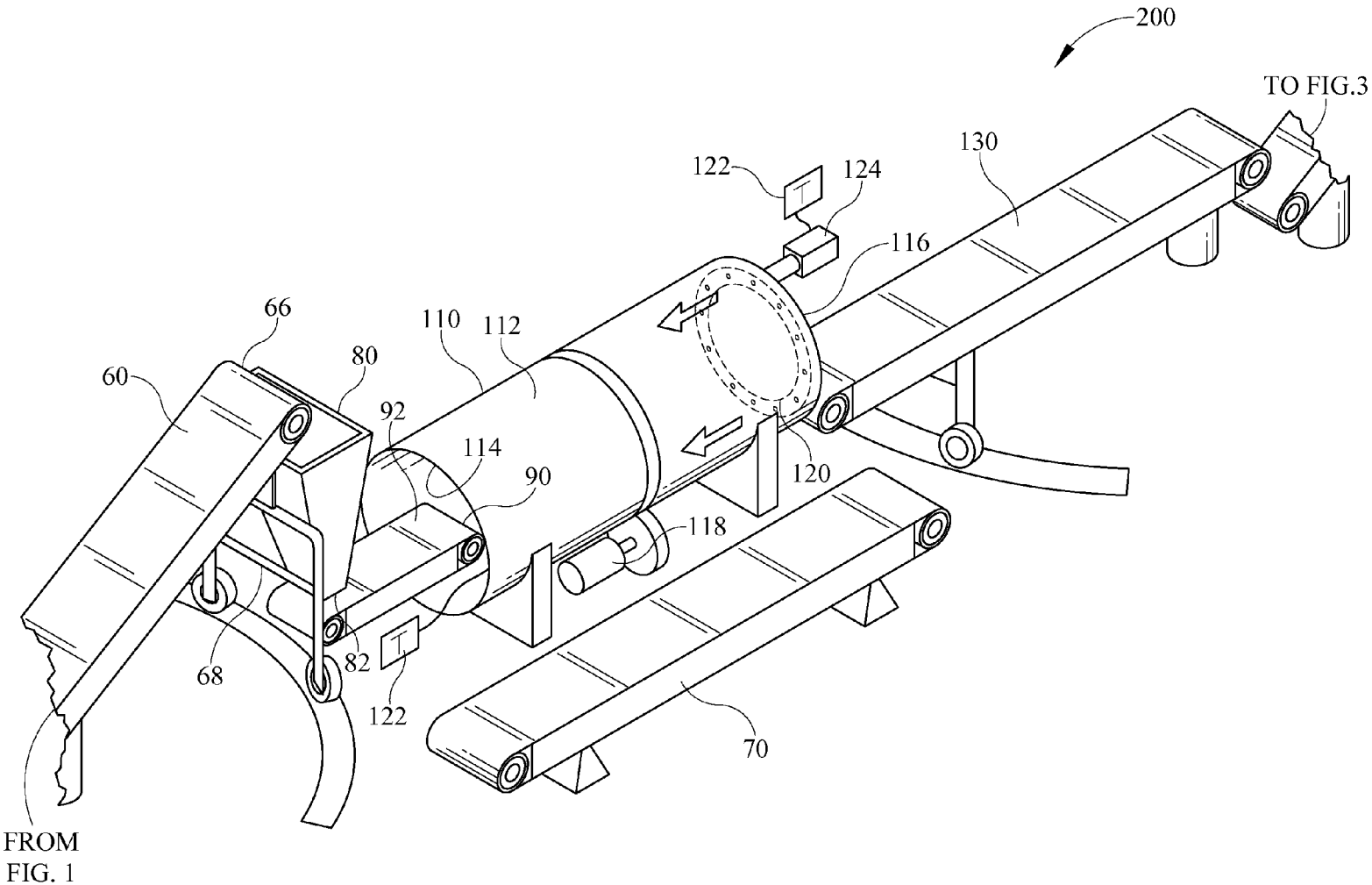
FIG. 2 is a partial process flow diagram of the pre-treatment system of the system and method of extracting bitumen from tar sands in accordance with one embodiment of the present invention.
Figure 3:
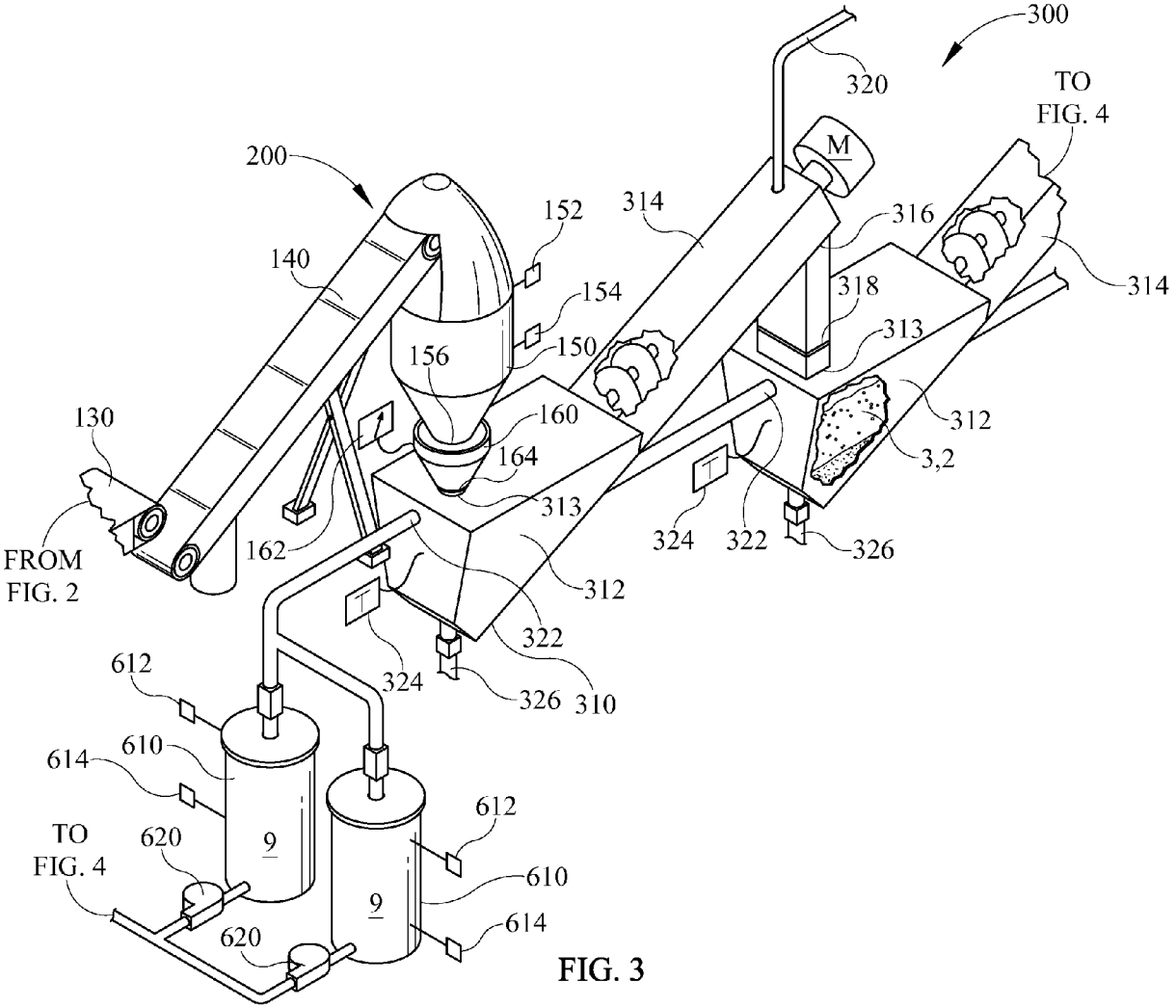
FIG. 3 is a partial process flow diagram of the extraction system of the system and method of extracting bitumen from tar sands in accordance with one embodiment of the present invention.

Referring now specifically to FIGS. 1-3, a pre-treatment system 200 is shown for preparing tar sands 2 for further processing. Pre-treatment system 200 comprises a vibratory load hopper 20, or a plurality thereof, for classifying tar sands 2 loaded therein from tar sand 2 piles. Vibratory load hopper 20 may include an inlet 22 for accepting tar sand 2 and a screen 24 that covers inlet 22 having plurality of apertures therein of a predetermined size for classifying tar sand 2 particles as they pass through screen 24. Load hopper 20 may further comprise an electric motor (not shown), as is well known to one of ordinary skill in the art for imparting a vibratory force to load hopper 20, thereby reducing the size of any clumps of tar sand 2. Load hopper 20 also includes a discharge outlet 26 for depositing tar sand 2 onto a double belt conveyor 40 for further processing. As is well known in the art, oversized particles may be removed from load hopper 20 via a discharge chute and concomitant conveyor (not shown) to an oversized feed stock 2 pile. In one embodiment of the present invention tar sand 2 exiting load hopper 20 through discharge outlet 26 onto belt conveyor 40 is reduced to a particle size of approximately 10 mesh. Throughout this specification a variety of conveyors will be described in the context of the instant invention. It should be understood that these conveyors are driven or energized by conventional, known means, such as electric motors either driving conveyor belts directly, or through gear boxes, transmissions, belt drives and the like.

Belt conveyor 40 comprises a drive belt 42 for conveying tar sand 2 away from load hopper 20 and a plurality of belt scales 44, each having a concomitant recorder and display 46 permitting an operator to view the weight of tar sand 2 traversing belt conveyor 40. Furthermore, each scale 44 provides an electrical output 48 representative of the weight of tar sand 2 being transported on belt conveyor 40 to a controller 100 for use in automating system 10 operation, as will be discussed in greater detail herein below. Controller 100 may comprise any one of many known in the art industrial controllers which typically comprise a microprocessor 102, data memory 104 for storing process information, and a plurality of inputs 106 and outputs 108, both analog and digital, for accepting and providing electrical process signals to system 10 equipment. Typically controllers 100 include programmable logic controllers (PLC's) commercially available from manufacturers such as Allen-Bradley, Texas Instruments, GE Fanuc, and many others. One of ordinary skill in the art will recognize that a wide variety of available controllers 100 may be employed in practicing the system 10 and method of the instant invention without departing from the scope of the claims appended hereto.

Once conveyed across belt conveyor 40, tar sand 2 is deposited on a radial lift conveyor 60 having a belt 62 for moving material from a first end 64 to an elevated end 66 thereof for delivery into a dryer feed hopper 80. Radial lift conveyor 60 further comprises a movable carriage 68 that acts to elevate end 66 of conveyor 60 for delivery to feed hopper 80 and also to rotate end 66 of radial conveyor 60 to enable tar sand 2 to be deposited onto a bypass conveyor 70. Bypass conveyor 70 is employed only when prevailing weather conditions have rendered tar sand 2 stock piles sufficiently dry to bypass the drying process. Typically, however, radial lift conveyor 60 delivers tar sand 2 into dryer feed hopper 80 that includes an outlet 82 at a lower end thereof through which tar sand 2 is deposited onto a pre-dryer feed conveyor 90, having a rotating belt 92 thereon.

As best seen in FIG. 2, a pre-dryer 110 for reducing moisture content in feed stock 2 to, for example, approximately 3% by weight, comprises a rotating drum 112 having an inlet 114 into which feed conveyor 90 deposits tar sand 2, an outlet 116 for removing dry tar sand 2, and a motor 118 drive, that provides constant rotation of drum 112. Pre-dryer 110 further includes a burner 120 disposed proximate the outlet 116 end drum 112 as well as a pair of temperature sensors 122, disposed proximate the inlet 114 and outlet 116 ends respectively of drum 112. Temperature sensors 122 have output signals representative of the actual temperature in drum 112 that are provided to controller 100 inputs 106. Burner 120 may comprise a conventional gas ring burner and may further include a gas control valve 124 or equivalent heat control that accepts an electrical output 108 signal from controller 100 to maintain a predetermined temperature $T_{dryer}$ as detected by temperature sensors 122. In one embodiment of the invention feed stock 2 is heated to approximately 214 degrees F. prior to exiting pre-dryer 110 to achieve the desired reduction in moisture content. By keeping tar sand 2 exiting pre-dryer 110 at a constant and relatively low moisture content, the downstream extraction process becomes much easier to control and maintain in a continuous fashion, since excess moisture in tar sand 2 has already been eliminated. A number of different fuel sources can be provided for use with burner 120, including but not limited to natural gas, liquid propane gas, kerosene, or diesel fuel without departing from the scope of the present invention. As can be seen from the directional arrows of FIG. 2 the flow of hot gas is opposite the flow of tar sand 2 through drum 112. Dry tar sand 2 exits pre-dryer 110 through outlet 116 where it is deposited on a radial transfer conveyor 130. Radial transfer conveyor 130 may be repositioned to accept tar sand 2 from bypass conveyor 70 when pre-dryer 110 is not necessary to remove moisture from feed stock 2.

Referring now to FIG. 3, pre-treatment system 200 radial transfer conveyor 130 deposits heated feed stock 2 from pre-dryer 110 onto a lift conveyor 140. Lift conveyor 140 then elevates feed stock 2 and deposits it into a feed hopper 150 having high and low level sensors 152 and 154 respectively, each of which provide electrical signals representative of the respective high and low feed hopper levels that are operatively connected to inputs 106 of controller 100. By monitoring feed hopper 150 levels, controller 100 can cease pre-treatment system 200 operations when a high level in hopper 150 is detected by sensor 152. Similarly, controller 100 may resume pretreatment system 200 operations when a low level of feed stock 2 is sensed in hopper 150 by low level sensor 154. Feed hopper 150 further includes an outlet 156 that is in fluid communication with a feeder 160, which may be either a volumetric of gravimetric type feeder for supplying extraction system 300 with feed stock 2. Feeder 160 may comprise a feed screw or other equivalent feed system having a feed control 162 that accepts an output 108 signal from controller 100 representative of a weight or volume of feed stock 2 to be treated in extraction system 300. Additionally, feeder 160 includes a vapor seal 164 that inhibits vapors from a solvent 3 utilized in extraction system 300 from escaping into the atmosphere or into pre-treatment system 200 components.

Referring again to FIG. 3, extraction system 300 comprises a plurality of sequentially arranged extractors 310 each of which include an extractor vessel 312 that accepts tar sand through an inlet 313, and contains both tar sand 2 and solvent 3 which is supplied via a solvent system 400, described in greater detail herein below. Extractors 310 further comprise a motor M driven conveyor 314, shown in the drawing Figures as screw conveyors, for transferring feed stock 2 from extractor 310 to the next extractor 310 in the sequence through an outlet 316, or alternatively out of the last extractor 310. As is known in the process automation arts, motors M may be controlled by outputs 108 from controller 100 and may further provide inputs 106 to controller 100 representative of motor M operating parameters. Outlet 316 of each extractor 310 includes therein a vapor seal 318 that prohibits solvent 3 vapors from escaping through outlet 316. Furthermore, each extractor 310 includes a vapor vent 320 that extracts solvent vapors from vessel 312 to be recovered through a solvent recovery process, also described further below.

Extractors 310 may additionally include at least one temperature sensor 324 provided to monitor the temperature of solvent 3 (and bitumen 1 in solution), which provide an electrical signal representative of solvent 3 temperature to controller 100 inputs 106 for use in operation of solvent system 400. Each extractor 310 is also provided with a drain 326 at a lower portion of vessel 312 which permits the draining of any water from extractor 310 as well as the taking of fluid samples to monitor process operation.

Each extractor 310 is in fluid communication with the previous extractor in the sequential series through a solvent overflow line 322 that permits solvent to flow through the series of extractors 310 from the "last" extractor 310 in the series to the "first" extractor 310 in the series. In other words, tar sand 2 is introduced into a first extractor 310 in the series and is transferred via screw conveyors 314 through the series to a "last" extractor 310. Conversely, solvent 3 is introduced into the "last" extractor 310 in the series and flows in an opposite direction to tar sand 2 through each extractor 310 solvent overflow line 322 until it exits the first extractor 310 through its solvent overflow 322 and is thus deposited into a pair of receiving tanks 610 that are part of a refining system 600, for further processing. The solvent 3 flow through the system is thus counter to the flow of feed stock 2 therethrough, thereby permitting solvent 3 to remove much of the bitumen 1 from feed stock 2 in solution and transfer it out of extractors 310 into receiving tanks 610. In one embodiment of the present invention each extractor 310 in the series of extractors 310 is positioned at a slightly higher elevation than the proceeding extractor 310 from first to last, such that solvent 3 introduced in the last extractor 310 is capable of flowing through the extractor 310

In one embodiment of the present invention, the counterflow of solvent 3 through the extractors 310 is provided in a 6 to 1 ratio (by weight) of solvent 3 to tar sand 2, thereby producing a bitumen 1 and solvent 3 solution in receiving tanks 610 that has significantly fewer fines or particulates than known-in-the art methods. The 6 to 1 solvent 3 to feed stock 2 ratio utilizes more solvent 3 than is presently known in the art. This feature of the present invention necessitates the recovery of solvent 3 from the bitumen-depleted sand 2 in order to efficiently operate system 10.

Figure 5:
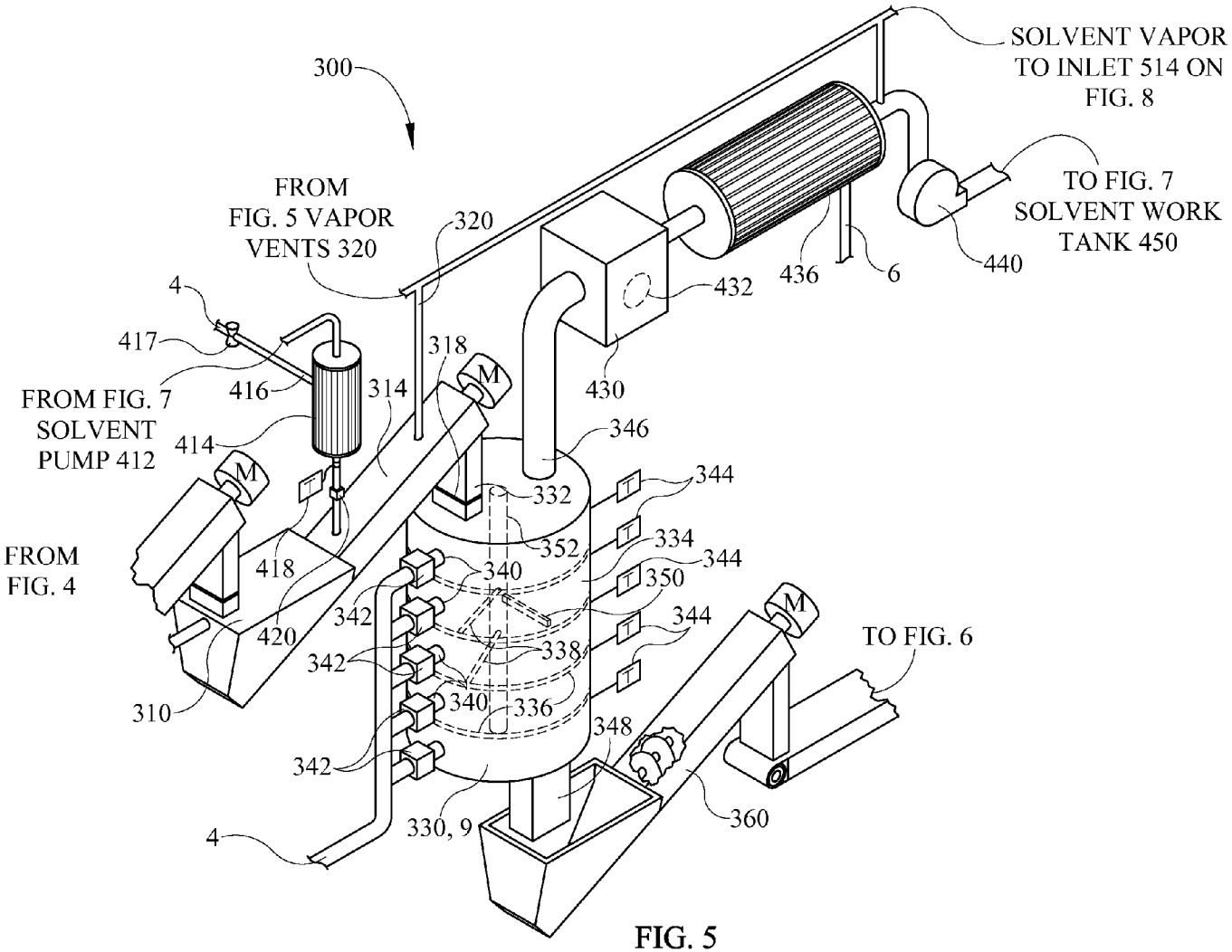
FIG. 5 is a partial process flow diagram of the extraction system of the system and method of extracting bitumen from tar sands in accordance with one embodiment of the present invention.

The final extractor 310 in the series thereof shown in FIG. 5, deposits tar sand 2 into a dissolventizer 330 through an inlet 332. Dissolventizer 330 comprises a vessel 334 having a plurality of horizontally arranged trays 336 therein, each tray 336 having a slot 338 in a portion thereof to enable sand deposited on a tray 336 to eventually drop or be swept into a lower tray 336. Each tray 336 may have a hollow interior for accepting a source of fluidized heat, for example steam 4 or water 6 to further heat tar sand 2 entering dissolventizer 330. Each tray 336 (or level) of dissolventizer 330 comprises a steam 4 inlet port 340 that is supplied with steam from a conventional steam 4 supply system (not shown) through independent steam control valves 342, each of which is energized by an output 108 from controller 100. Each tray is further provided with at least one temperature sensor 344 for monitoring the temperature at that point in dissolventizer 330. In one embodiment of the invention, the temperature in each level of the dissolventizer 330 is maintained in a range of 200 to 240 degrees F. in order to encourage vaporization of any remaining solvent in feed stock 2, such that feed stock 2 exiting dissolventizer 300 through an outlet 348 is essentially clean sand. Temperature at each tray 336 is maintained by controller 100 providing corresponding electrical outputs 108 to steam control valves 342, responsive to the temperature sensor 344 input 106 corresponding to each tray 336 in a closed loop feedback system.

Tar sand 2 entering dissolventizer 330 is deposited on top tray 336 where it is heated by the entering steam 4. Each tray 336 of dissolventizer 330 may also comprise a rotatable sweep arm 350 extending from a central shaft 352 that extends through each tray 336 which is operated to sweep tar sand 2 deposited on trays 336 through slots 338 and thus onto next lower tray 336 or into outlet 348. As tar sand 2 is heated throughout this process, solvent 3 vapors are liberated from sand 2 by operation of steam heat, and then rise upwardly, exiting dissolventizer 330 through a vapor vent 346 into solvent system 400.

Figure 6:
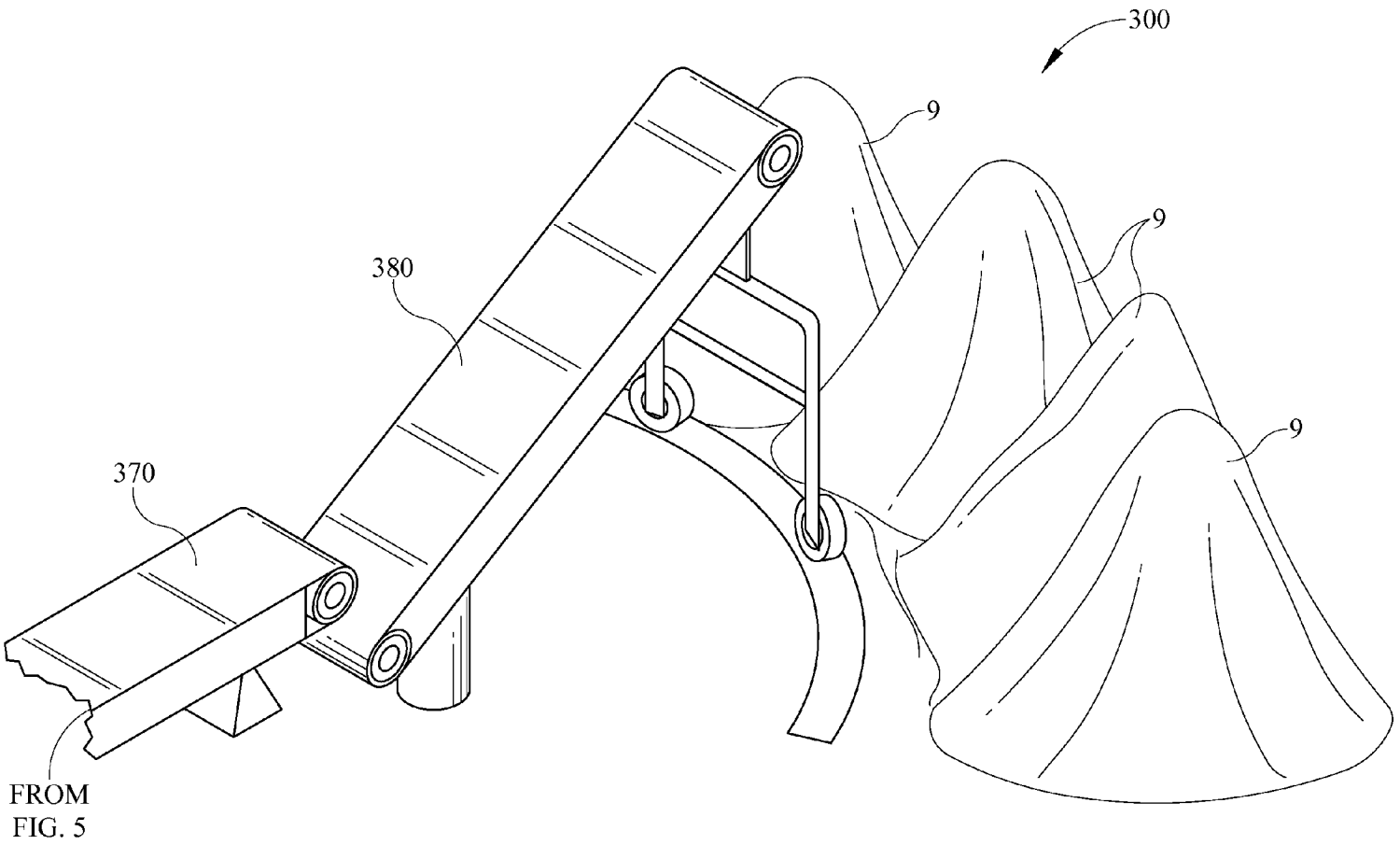
FIG. 6 is a partial process flow diagram of the extraction system of the system and method of extracting bitumen from tar sands in accordance with one embodiment of the present invention.

As best seen in FIGS. 5 and 6, clean sand 9 exiting outlet 348 is removed from dissolventizer 330 by operation of a discharge auger 360 which deposits sand 9 onto a discharger conveyor 370, which in turn deposits clean sand 9 onto a radial belt conveyor 380 for distribution into clean sand 9 stock piles. As is known in the art, auger 360, and conveyors 370, 380 are typically powered by electric motors, and may be automatically controlled by controller 100 responsive to a variety of process control variables.

Figure 7:
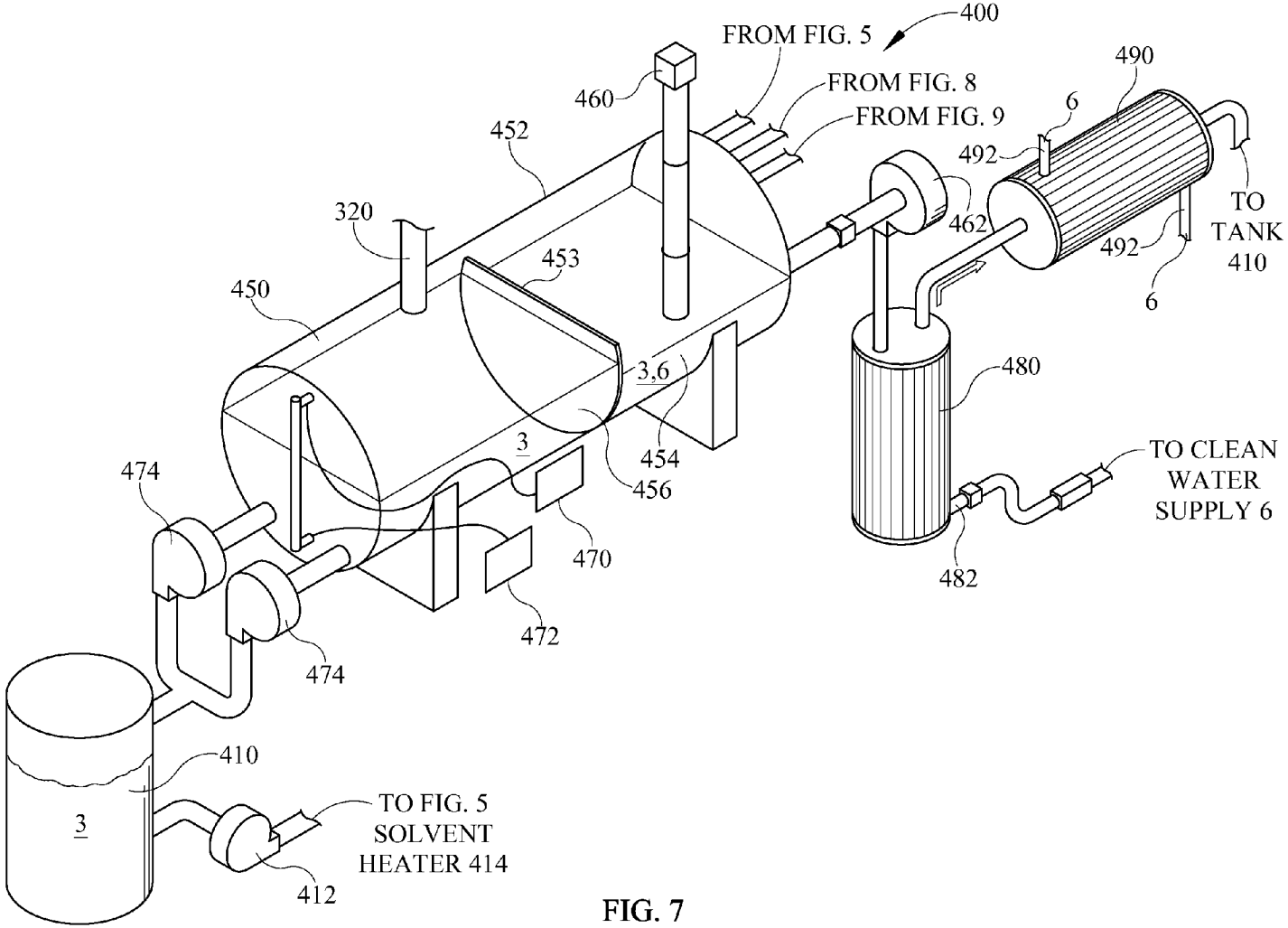
FIG. 7 is a partial process flow diagram of the solvent system of the system and method of extracting bitumen from tar sands in accordance with one embodiment of the present invention.
Figure 8:
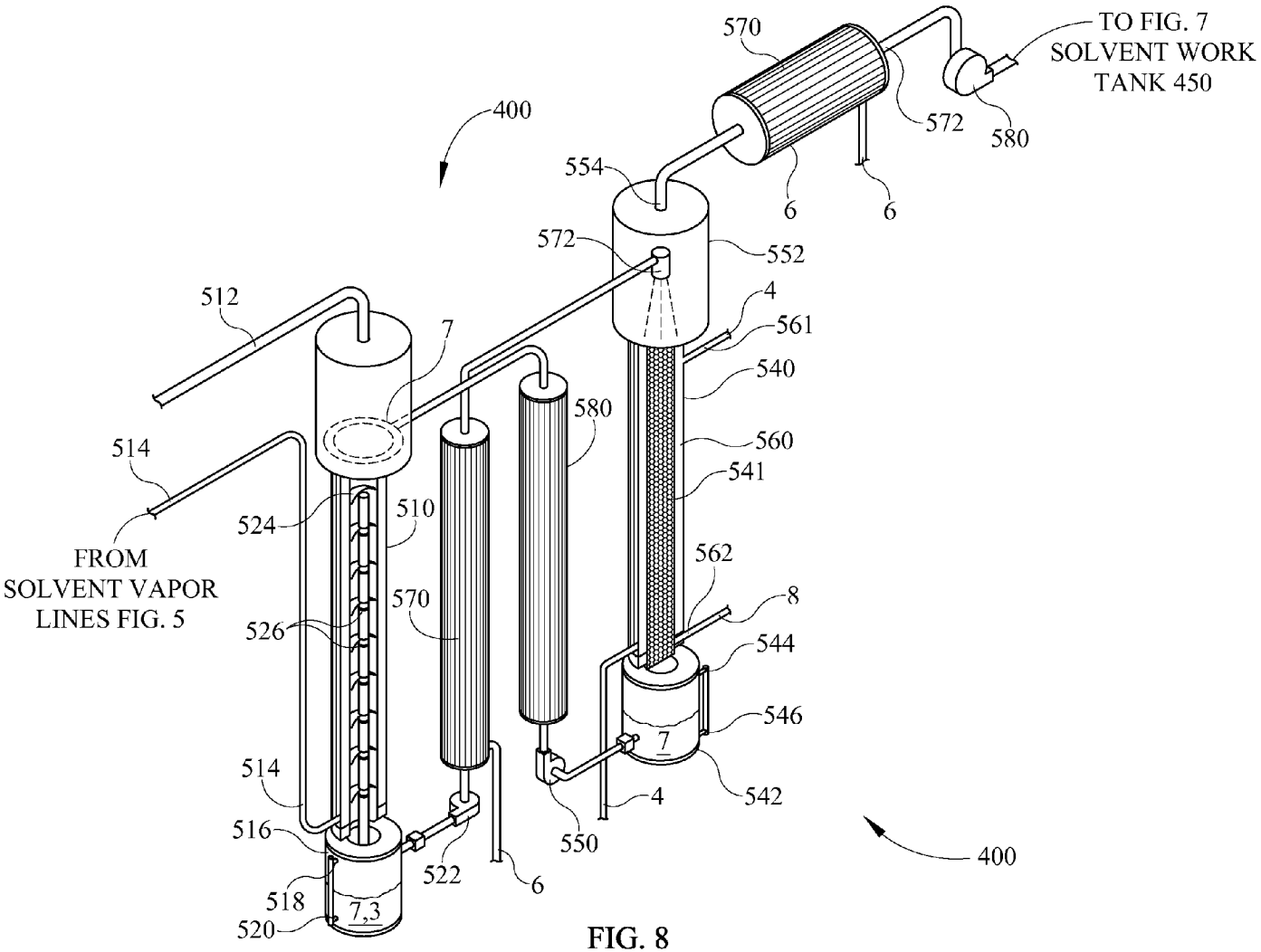
FIG. 8 is a partial process flow diagram of the solvent system of the system and method of extracting bitumen from tar sands in accordance with one embodiment of the present invention.

Referring now to FIGS. 5, 7 and 8, solvent system 400 comprises at least one solvent supply tank 410 for storing clean solvent 3, in fluid communication with a supply pump 412 for supplying clean solvent to extractors 310. While hexane and kerosene may be used as suitable solvents 3 in the system 10 and method of the invention, one of ordinary skill in the art will recognize that a wide variety of solvents may be employed in the extraction process without departing from the scope of the invention.

Solvent 3 is supplied by pump 412 to the last extractor 310 in the extractor series through a solvent pre-heater 414 that may conventionally comprise a tube and shell-type heater into which steam is supplied through a steam 4 inlet 416 as a heat source. Steam inlet 416 may be in fluid communication with a solvent heat control valve 417 that is actuated by an output 108 signal from controller 100 responsive to a desired solvent 3 temperature setpoint. A temperature sensor 418 is also provided to sense the temperature of solvent 3 entering extractor 310. In one embodiment of the invention, the solvent temperature entering extractor 310 is in the range of 140 to 200 degrees F. This temperature is maintained by controller 100 through varying the position of solvent heat control valve 417. Additionally, a solvent flow meter 420 is provided in fluid communication with solvent supply pump 412 to enable controller 100 to vary the operation of pump 412 to supply a precise flow of solvent 3 to extractor 310. Coupled with feed control 162 of feeder 160, controller 100 can precisely control the ratio of solvent 3 to feed stock 2 entering the extraction system 200, thereby providing for peak operating efficiency and system 10 throughput.

Referring again to FIG. 5, solvent vapors exiting dissolventizer 330 through vapor vent 346 and solvent vapors exiting extractors 310 through vapor vents 320 are piped through a drop-out box 430 comprising a plurality of baffles 432 therein that slows the velocity of solvent 3 vapor entering box 430 thus forcing fine particulates entrained in the vapor 3 stream to drop out of the stream, into the bottom of drop-out box 430. Drop-out box 430 is in fluid communication with a solvent condenser 436, having a conventional tube and shell design and supplied by a source of cooling water 6. Solvent 3 vapor thus enters condenser 436, is cooled, and is removed through operation of solvent condensate pump 440 to a work tank 450 for further processing.

Referring now to FIG. 7 work tank 450 comprises a vessel 452 having a weir 453 separating first and second portions 454 and 456, respectively, of the interior of vessel 452. First portion 454 of vessel 452 is in fluid communication with solvent 3 and water supplied by condensate pump 440, as well as solvent and water recovered from a solvent absorber and the distillation system 600, which will be described further herein below. First portion 454 of vessel 452 includes a water level sensor 460 operatively coupled to controller 100, and a water 6 withdrawal pump 462 that is operated by controller 100 to maintain water 6 in first portion 454 at a constant level. Since solvent 3 is typically less dense that water, solvent 3 floats on top of water 6 in vessel 454 until it reaches the top of weir 453, at which point it flows into second portion 456 of vessel 452.

Second portion 456 of vessel 452 comprises a high level sensor 470 and a low level sensor 472, as well as a pair of redundant pumps 474 in fluid communication with second portion 456 of vessel 452 for removing clean solvent 3 from work tank 450 to solvent supply tank 410. High level sensor 470 provides a signal indicative of a high fluid level in second portion 456 of vessel 452 to controller 100. Similarly, low level sensor 472 provides a signal indicative of a low fluid level in second portion 456 of vessel 452 to controller 100. Accordingly, pumps 474 are operated by a control output from controller 100 responsive to detection of a high level signal from sensor 470, thereby removing clean solvent 3 from vessel 452 and supplying it to supply tank 410. Upon receiving a low level signal from sensor 472, controller 100 deactivates pumps 474 and waits until a high level signal is detected to repeat the solvent withdrawal process.

Once water level sensor 460 detects a water level in first portion 454 of vessel 452 greater than a predetermined maximum, controller 100 activates pump 462 to withdraw water 6 from a bottom portion of vessel 452. Withdrawn water is pumped into a tube and shell-type steam heater 480 that vaporizes any remaining solvent 3 since solvent 3 has a much lower boiling point than water. Heater 480 has an outlet 482 at a lower portion thereof for removing clean water 6 which may then be monitored by one of many conventional methods, for example gas chromatograph. Vaporized solvent is then routed through a tube and shell condenser 490 having a cool water supply 492 that condenses solvent 3 that is then removed to solvent supply tank 410.

Referring now to FIG. 8 a solvent system 400 that enables the recovery of solvent 3 for re-use in system 10 includes a first light oil tower 510 having a vacuum line 512 at an upper portion thereof for pulling solvent vapors into tower 510 as well as a solvent vapor inlet 514 at a lower portion of tower 510 through which solvent 3 vapors from extractors 310 enter tower 510. Tower 510 is in fluid communication with a light oil and solvent tank 516 at a bottom portion thereof for collecting a solution of solvent 3 and light oil 7. Tank 516 may include a high level sensor 518, a low level sensor 520, and a transfer pump 522 for transferring the light oil 7 and solvent 3 solution. Tower 510 may comprise a conventional disc 524 and doughnut 526 type fractionation tower that is provided with a supply of light oil 7 at an upper portion thereof that suspends solvent 3 in the oil 7 as the oil travels downwardly through tower 510 and solvent 3 vapors travel upwardly therethrough, being pulled by vacuum line 512.

Solvent system 400 further comprises a second tower 540, having a plurality of ceramic chips 541 or equivalent non-reactive particles therein for increasing surface area through tower 540, said second tower 540 having a light oil 7 supply tank 542 at a lower portion thereof. Light oil 7 supply tank 542 includes a high level sensor 544 and a low level sensor 546, each providing a signal indicative of their respective light oil 7 levels as inputs 106 to controller 100. Additionally, light oil 7 supply tank 542 is in fluid communication with a supply pump 550 that transfers light oil to first light oil tower 510. Second tower 540 is also in fluid communication with an expander dome 552 at a top portion thereof, thereby permitting solvent 3 vapor velocity to slow prior to entering a condenser 570 that is in fluid communication with an outlet 554 of expander dome 552. Condenser 570 may comprise a conventional tube and shell type condenser having a cold water supply 6 for condensing solvent from the solvent 3 vapor exiting expander dome 552. Condenser 570 has a fluid outlet 572 in fluid communication with a pump 580 that transfers the condensed solvent 3 and any water 6 therein to solvent work tank 450 for the previously described water 6 and solvent 3 separation process.

Second tower 540 may further comprise a steam jacket 560 surrounding a large portion of tower 540, supplied with a source of steam 4 through a steam inlet 561. Additionally, a source of super-heated steam 8 is supplied through a super-heated steam inlet 562 in fluid communication with the bottom of second tower 540 that permits super-heated steam to rise through ceramic chips 541 in second tower 540 as solvent 3 and oil 7 solution falls through tower 540.

Connecting first tower 510 transfer pump 522 and second tower 540 is a pre-heater 570, for example a tube and shell type pre-heater supplied with a source of steam 4, for heating the light oil 7 and solvent 3 mixture to approximately 250 degrees F. prior to it's entry into a top portion of second tower 540 through a spray nozzle 572 that disperses the mixture into second tower 540. Furthermore, connecting second tower 540 pump 550 and first tower 510 is a cooling tower 580 provided with a source of cold water 6 to cool pure light oil 7 being pumped to an upper portion of first tower 510.

In operation, the first and second towers 510 and 540 process solvent 3 vapor as follows: pure light oil 7 is pumped via pump 550 into first tower 510 at an upper portion thereof while solvent 3 vapor is pulled via vacuum line 512 into a lower portion of first tower 510. As light oil 7 flows downwardly over discs 524 and doughnuts 526 solvent 3 is trapped in light oil 7 and thus flows in solution into tank 516. Pump 522 then pumps the oil 7 and solvent 3 solution through pre-heater 570 where it obtains a temperature of approximately 250 degrees F., whereupon it flows through spray nozzle 572 thence downwardly through second tower 540. Simultaneously super-heated steam 8 flows upwardly through second tower 540 thereby vaporizing solvent 3 in solution with light oil 7 and removing it through expander dome 552 and ultimately condenser 570 and pump 580. Pure light oil 7 flows through operation of gravity into tank 542 whereupon the absorption process is repeated.

Figure 4:
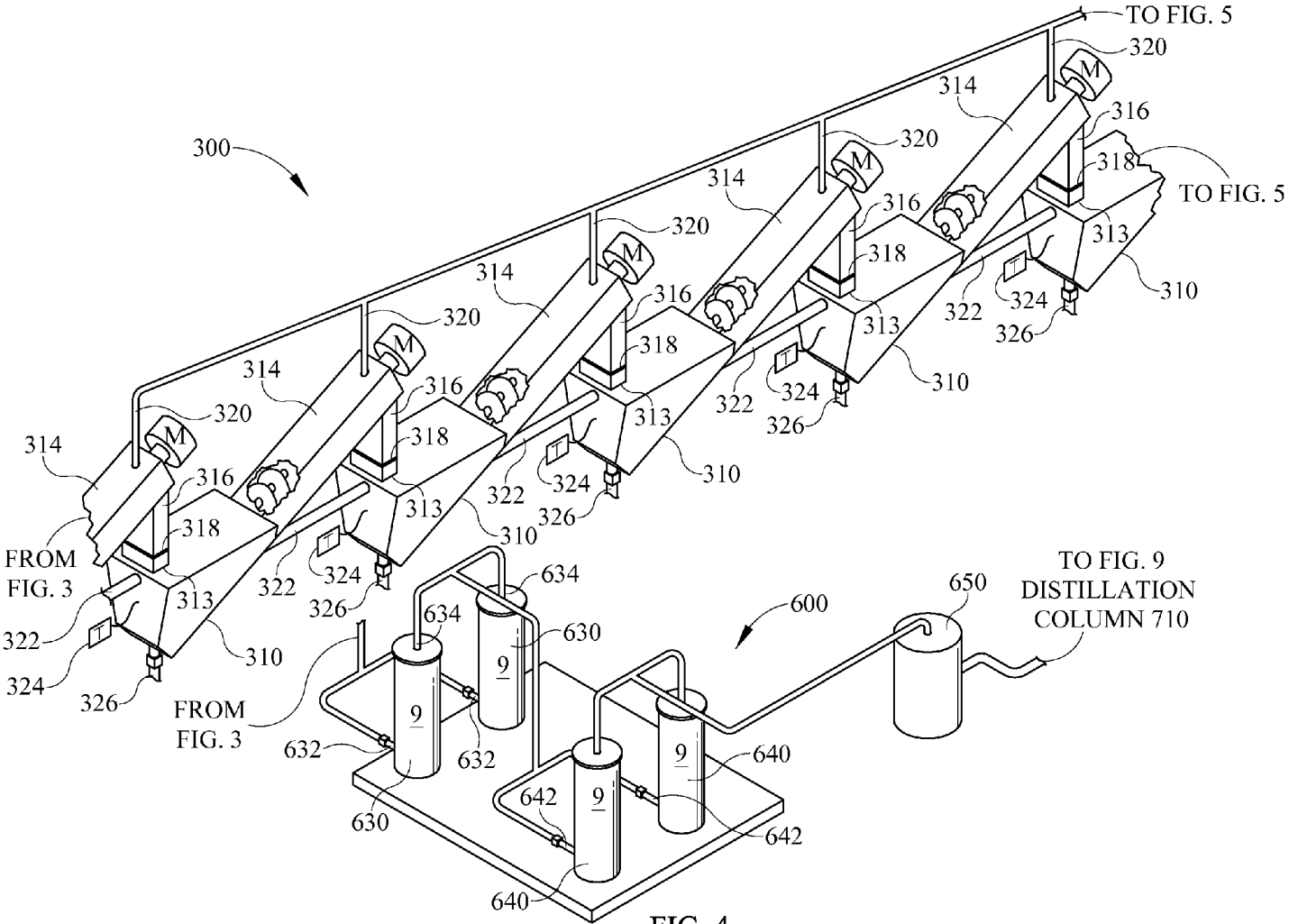
FIG. 4 is a partial process flow diagram of the extraction and refining systems of the system and method of extracting bitumen from tar sands in accordance with one embodiment of the present invention.

Referring now to FIGS. 3 and 4 the refining system 600 of the present invention comprises receiving tanks 610 that are used to collect the solvent 3 and bitumen 1 mixture, known in the art as "miscella" solution 9. Each receiving tank 610 includes a high level sensor 612 and a low level sensor 614, each of which provide a signal representative of tank 610 level to controller 100. A pair of transfer pumps 620 are in fluid communication with receiving tanks 610 and a pair of first stage filters 630 such that pumps 620 transfer miscella solution 9 from receiving tanks 610 to filters 630 responsive to controller 100 receiving a high level input 106 signal from either high level sensor 612. Controller 100 activates the pump 620 corresponding to the tank 610 that detects a high level, and then de-activates pumps 620 when a low level input 106 signal is detected from low level sensor 614 of that receiving tank 610.

First stage filters 630 are arranged as redundant filtration devices to remove particulate matter from miscella solution 9 and may comprise a conventional 100 micron mesh filter. Miscella solution 9 enters filters 630 through inlets 632 in a lower portion thereof and flows upwardly through filters 630 until it is forced to exit through outlets 634. Inlets 632 on filters 630 may be equipped with valves such that flow to one filter 630 may be shut off to maintain or backwash filter 630 while redundant filter 630 is still in operation. Filter 630 outlets 634 are in fluid communication with inlets 642 of second stage redundant filters 640. In an exemplary embodiment of the invention second stage filters 640 may comprise 5 micron mesh filters. Miscella solution 9 flows upwardly from inlets 642 to outlets 644 and then to a miscella solution 9 storage tank 650, from which miscella solution 9 is withdrawn by refining system 600. Inlets 642 on second stage filters 640 may be equipped with valves such that flow to one filter 640 may also be shut off to maintain or backwash filter 640 while redundant filter 640 remains in operation.

Figure 9:
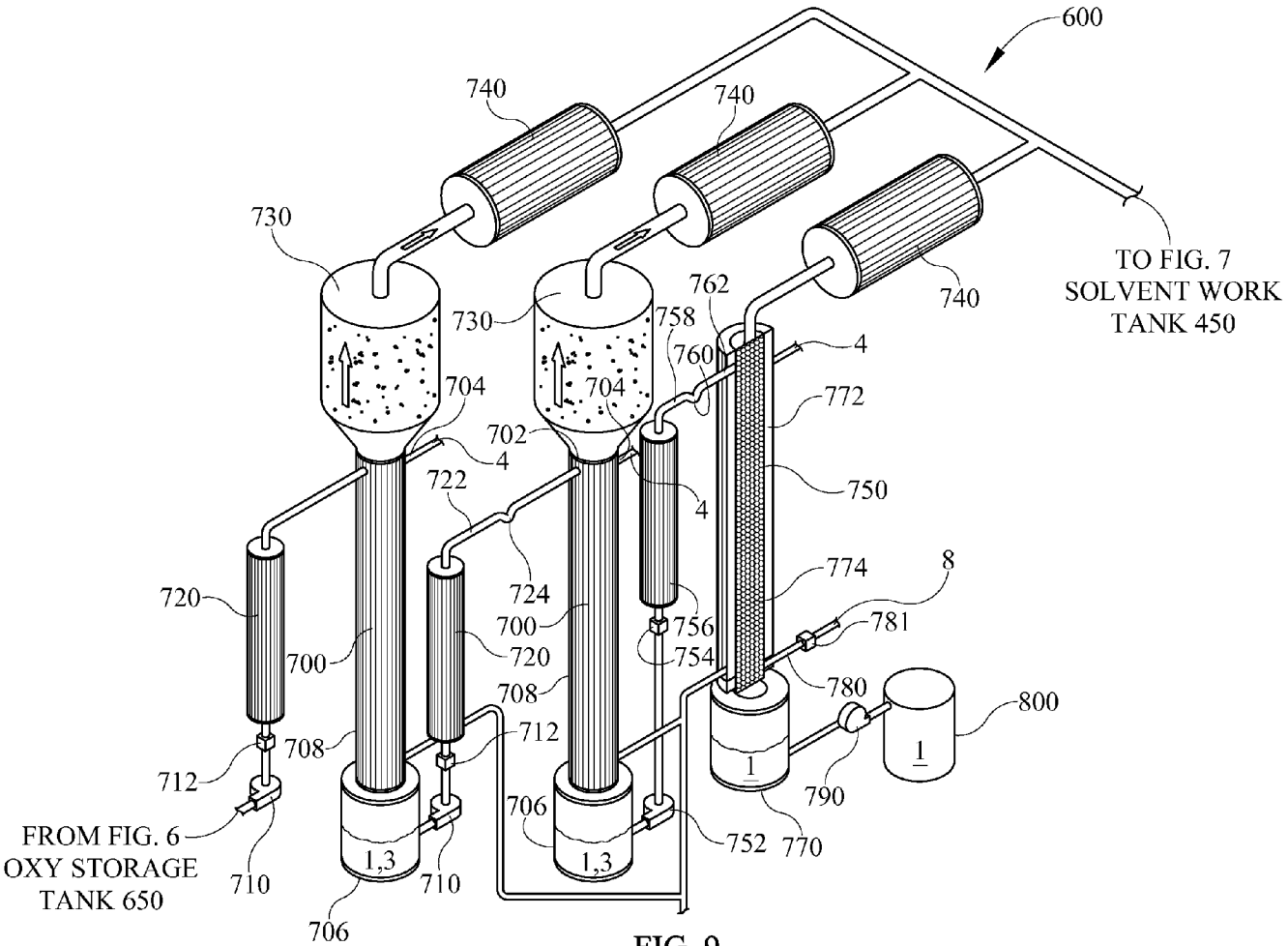
FIG. 9 is a partial process flow diagram of the refining system of the system and method of extracting bitumen from tar sands in accordance with one embodiment of the present invention.

FIG. 9 depicts the distillation process of refining system 600, which comprises first and second distillation columns 700 as well as a stripper column 750 for refining bitumen 1 from miscella solution 9. Distillation columns 700 each include a supply pump 710 in fluid communication with a flow control valve 712 that is operably connected to an output 108 of controller 100 to control the flow of miscella solution 9 into distillation columns 700. First distillation column 700 pump 710 withdraws miscella solution 9 from miscella storage tank 650, shown on FIG. 6. Flow control valves 712 are in fluid communication with pre-heaters 720, for example tube and shell-type pre-heaters supplied with a source of steam 4, which are in turn connected to inlets 702 at a top portion of distillation columns 700 to permit entry of miscella solution 9. Pre-heaters 720 may heat miscella solution 9 to, for example, approximately 240 degrees F. prior to its entry into distillation column 700. Also at an upper portion of distillation columns 700 are steam inlets 704 which admit a source of high pressure steam into distillation columns 700 to vaporize solvent 3 from miscella solution 9.

In fluid communication with first and second distillation columns 700, and disposed at a lower portion thereof, are collection tanks 706 for collecting bitumen 1 and any remaining solvent 3 after miscella solution 9 passes through distillation columns 700. First column 700 collection tank 706 is in fluid communication with pump 710 associated with second column 700 to supply the partially distilled miscella solution 9 to second distillation column 700. Each distillation column 700 is preferably provided with an insulating covering 708 that facilitates maintaining a temperature sufficient to vaporize solvent 3 inside columns 700. Additionally, each distillation column 700 also includes an expander dome 730 that is in fluid communication with an upper portion of distillation column 700 to reduce the velocity of solvent 3 vapor rising through distillation column 700 as it exits. Expander domes 730 are each in fluid communication with conventional condensers 740 that are employed to condense solvent 3 (and water 6) vapor whereby it is returned to work tank 450 for water separation.

A miscella solution line 722 connecting pre-heater 720 to second distillation column 700 includes a liquid trap 724 therein to inhibit solvent 3 vapor flow from one distillation column 700 to the next. In one embodiment of the instant invention the miscella solution 9 collected in tank 706 of first distillation column 700 comprises approximately 40% solvent and 60% bitumen while the miscella solution 9 in tank 706 of second distillation column 700 comprises approximately 7% solvent and 93% bitumen.

A stripper column supply pump 752 is provided in fluid communication with tank 706 of second distillation column 700 to supply partially distilled bitumen 1 through a flow control valve 754 to a stripper column pre-heater 756 to heat the partially distilled miscella solution 9 again to approximately 240 degrees F. Control valve 754 is operably connected to an output 108 of controller 100 to enable precise flow control of miscella solution 9 to stripper column 750. After exiting pre-heater 756 miscella solution 9 is routed through line 758, vapor trap 760 thence into inlet 762 of stripper column 760 that is located proximate a top portion of column 760.

Stripper column 750 comprises a collection tank 770 at a bottom portion thereof for collecting refined bitumen 1 and a steam jacket 772 surrounding column 750 to assist in maintaining the internal temperature. Stripper column 750 further comprises a plurality of ceramic chips 774 disposed in the interior of column 750 for maximizing the surface area therein. Furthermore, a super-heated steam inlet 780 is in fluid communication with a lower portion of stripper column 750 into which a source of super-heated steam 8 is injected. Super-heated steam 8 injection may be controller by a steam control valve 781 that accepts an input 106 from controller 100 representative of valve position. Stripper column 750 includes a vapor outlet 782 at an upper end thereof in fluid communication with a condenser 740 for collecting and condensing vaporized solvent 3 and water 6 and returning them to work tank 450 for separation.

In operation miscella solution 9 is pumped from tank 706 of second distillation column 700 through flow control valve 754 to regulate the flow of miscella solution 9, into pre-heater 756, and finally into stripper column inlet 762. Simultaneously, super-heated steam is introduced into steam inlet 780 at a bottom While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A method of removing bitumen from tar sand comprising the steps of:

a.) sizing and drying said sand to reduce the moisture content thereof;

b.) providing a plurality of sealed bitumen extractors arranged in series, including a first and last extractor;

c.) providing a predetermined volume of said tar sand to said bitumen extractors, said tar sand flowing from said first extractor to said last extractor;

d.) providing a predetermined volume of solvent to said last extractor, said solvent flowing from said last extractor to said first extractor;

e.) withdrawing a solvent and bitumen solution from said first extractor;

f.) withdrawing said tar sand from said last extractor;

g.) removing remaining solvent from said sand withdrawn from said last extractor;

h.) refining said bitumen and solvent solution to separate said solvent and said bitumen; and j.) recovering said solvent used in steps d through h for further use.

2. A method of removing bitumen from tar sand as claimed in claim 1 wherein step d) comprises:

providing solvent at a volume sufficient to result in a solvent and bitumen solution having a 6:1 weight ratio.

3. An improved system for removing bitumen from tar sands comprising:

a pre-treatment system comprising a vibratory load hopper for classifying and sizing said tar sand particles, communicating with a dryer for heating and drying said tar sand particles to a predetermined temperature thereby controlling the moisture content of said tar sands;

an extraction system for accepting said tar sands from said dryer comprising a plurality of extractor arranged in series for transporting said tar sands therethrough from a first extractor to a last extractor; and a solvent system for supplying a predetermined volume of solvent flow through said extractors whereby said solvent is supplied to said last extractor and a solvent and bitumen mixture is withdrawn from said first extractor.

4. An improved system for removing bitumen from tar sands as claimed in claim 3 comprising:

a pre-treatment system comprising a conveyor for transferring tar sands from said vibratory load hopper to said dryer, said conveyor having at least one scale for determining the weight of said tar sand entering said pre-dryer; and a solvent system having a solvent flow control for providing a predetermined flow volume of solvent through said extraction system based upon the weight of said tar sand entering said pre-dryer.

5. An improved system for removing bitumen from tar sands as claimed in claim 4 wherein the ratio of solvent to bitumen withdrawn from said first extractor is approximately 6 to 1 by weight.

6. An improved system for removing bitumen from tar sands as claimed in claim 5 wherein said solvent flow control system comprises a flow control responsive to said ratio of solvent to bitumen.

7. An improved system for removing bitumen from tar sands as claimed in claim 4 comprising:

a pre-treatment system having a volumetric feeder arranged between said dryer and said first extractor, having an outlet for supplying a predetermined volume of tar sand to said extraction system.

8. An improved system for removing bitumen from tar sands as claimed in claim 7 comprising:

a vapor seal disposed between said feeder outlet and said extraction system to prevent solvent vapor from exiting said extraction system.

9. An improved system for removing bitumen from tar sands as claimed in claim 4 comprising:

a solvent system for reclaiming used solvent having a work tank for collecting liquid solvent and water in solution used in said system, said work tank having first and second portions and a water and solvent separation weir therebetween, wherein said solvent flows over said weir into said second tank portion and is removed to a storage tank, and wherein said water is withdrawn from said first tank portion and distilled to remove remaining solvent therefrom.

10. An improved system for removing bitumen from tar sands as claimed in claim 9 comprising:

a solvent system for reclaiming solvent vapors having a first light oil fractionation tower having an oil and solvent solution tank in fluid communication with a lower portion thereof, and having a supply of light oil introduced at an upper portion thereof, and a solvent vapor inlet at a lower portion thereof whereby said solvent vapor rising through said first tower is trapped in said light oil and then collected in said oil and solvent solution tank; and a second light oil fractionation tower having an expander dome in fluid communication with an upper portion thereof for collecting solvent vapors, said expander dome in fluid communication with a condenser for condensing solvent vapor into liquid solvent;

a light oil tank at a lower portion thereof, supplied with pure light oil;

a solvent and oil solution spray nozzle at an upper portion of said second tower in fluid communication with said oil and solvent solution tank of said first tower; and a super-heated steam inlet proximate a lower portion of second tower for accepting a supply of super-heated steam to vaporize said solvent from said solution introduced into said second tower through said spray nozzle.

11. An improved system for removing bitumen from tar sands as claimed in claim 3 wherein said dryer comprises a gas burner for supplying heat to said pre-dryer and plurality of temperature sensors positioned in said dryer for monitoring the temperature of said tar sand exiting said dryer.

12. An improved system for removing bitumen from tar sands as claimed in claim 3 wherein said dryer reduces the moisture content of said tar sands to approximately 3% by weight.

13. An improved system for removing bitumen from tar sands as claimed in claim 3 comprising:

a dissolventizer comprising a vessel in fluid communication with the last extraction vessel for drying bitumen-depleted tar sand and removing residual solvent therefrom, said vessel comprising an inlet at an upper end thereof, a plurality of generally horizontal spaced trays for accepting said sand thereon for drying, each tray having at least one slot therein for permitting said sand to fall through onto an adjacent lower tray, an outlet having a vapor seal below a lowest tray for discharging clean sand, and a vapor vent proximate an upper portion of said vessel for removing solvent vapor from said dissolventizer; and a plurality of steam inlets in communication with said vessel for accepting a supply of steam for heating said sand and thus vaporizing said solvent, whereby said steam and solvent vapor are removed through said vapor vent.

14. An improved system for removing bitumen from tar sands as claimed in claim 13 comprising:

a dissolventizer having a central shaft mounted vertically in said vessel, and plurality of rotating sweep arms extending from said shaft generally parallel to said trays, for sweeping said sand through said tray slots, each of said sweep arms having a central bore in fluid communication with said supply of steam and a plurality of apertures in said sweep arms in fluid communication with said central bore for delivery of said steam to said sand.

15. An improved system for removing bitumen from tar sands as claimed in claim 13 wherein said steam pressure is in a range of 150 to 600 psi.

16. An improved system for removing bitumen from tar sands as claimed in claim 13 comprising:

a distillation system for separating said bitumen from said bitumen and solvent mixture comprising:

a first distillation column having a steam jacket for heating said solvent and bitumen mixture, a vapor port at an upper end thereof for removing vaporized solvent, and a solution tank at a lower portion thereof for collecting bitumen and solvent in solution;

a second distillation column having a steam jacket for heating said solvent and bitumen solution in said solution tank of said first distillation column, a vapor port at an upper end thereof for removing vaporized solvent, and a bitumen and solvent solution tank at a lower portion thereof; and a stripper column having a steam jacket for heating said solvent and bitumen mixture supplied from said solution tank of said second distillation column, a super-heated steam supply for supplying super-heated steam at a plurality of points to said stripper column, a vapor port at an upper end thereof for removing vaporized solvent from said stripper column, and a de-solventized bitumen tank at a lower portion thereof for collecting said bitumen.

17. An improved system for removing bitumen from tar sands as claimed in claim 16 comprising:

a pair of pre-heaters for heating said bitumen and solvent solution entering said first and second distillation columns.

18. An improved system for removing bitumen from tar sands as claimed in claim 17 wherein said bitumen and solvent solution is heated to approximately 240 degrees Fahrenheit prior to entry into said distillation columns.

19. An improved system for removing bitumen from tar sands as claimed in claim 16 comprising:

a pre-heater for heating said bitumen and solvent solution entering said stripper column.

20. An improved system for removing bitumen from tar sands as claimed in claim 19 wherein said bitumen and solvent solution is heated to approximately 240 degrees Fahrenheit prior to entry into said stripper column.

* * * * *